United States Patent [19]

Hood

[11] 3,975,980

[45] Aug. 24, 1976

[54] METHOD AND APPARATUS FOR MANUFACTURING FAIRED ARTICLE

[75] Inventor: Henry Alexander Hood, Morrestown, N.J.

[73] Assignee: Wall Industries, Inc., Beverly, N.J.

[22] Filed: June 4, 1975

[21] Appl. No.: 583,653

Related U.S. Application Data

[63] Continuation-in-part of Ser. No. 499,278, Aug. 21, 1974, abandoned.

[52] U.S. Cl. ..... 87/6; 87/7; 87/11; 87/29; 87/30

[51] Int. Cl.[2] ..... D04C 1/12; D04C 3/12

[58] Field of Search ..... 87/5, 6, 7, 8, 9, 11, 87/13, 28–30, 33, 41

[56] References Cited

UNITED STATES PATENTS

| | | | |
|---|---|---|---|
| 387,075 | 7/1888 | Hood | 87/41 |
| 2,196,900 | 4/1940 | Girard et al. | 87/30 |
| 2,257,953 | 10/1941 | Haskell | 87/6 |
| 2,354,212 | 7/1944 | Jeckel | 87/11 |
| 2,388,693 | 11/1945 | Jeckel | 87/9 |
| 2,407,929 | 9/1946 | Jeckel | 87/11 |
| 2,494,389 | 1/1950 | Jeckel | 87/11 X |

*Primary Examiner*—John Petrakes
*Attorney, Agent, or Firm*—Stanley B. Kita

[57] ABSTRACT

An elongated article such as a rope or cord having a series of fairings spaced apart along its length is produced in a continuous manner by the method and apparatus of the present invention. The rope comprises a core having a plurality of yarns surrounded by a layer of resilient material, and a braided jacket surrounds the core and anchors the fairings thereto. The fairings are provided by a resilient fairing yarn which is fed toward the core and which is manipulated by a needle during braiding of the jacket to cause each fairing to have a base portion anchored between the jacket and the resilient layer of the core and streamer portions extending outwardly from the base portion. The needle is mounted for reciprocation parallel to the moving core upstream of the braider, and the fairing yarn passes through the eye of the needle and a first length is displaced through the path of movement of the braid yarns into engagement with a gripping assembly located downstream of the braid yarns. The gripping assembly holds the first length of fairing yarn so that as the needle retracts, another length of braid yarn is pulled through the needle-eye. Continued operation of the braider causes the jacket to be applied around the portion of the fairing yarn engaged with the core, thereby forming the base portion for the next fairing. A control system is disclosed for synchronizing movement of the needle with the displacement of the rope and for adjusting of the spacing between the fairings.

In another embodiment, a method and apparatus is disclosed for producing a faired article which does not have a separately-formed core.

17 Claims, 20 Drawing Figures

METHOD AND APPARATUS FOR MANUFACTURING FAIRED ARTICLE

The present application is a continuation-in-part of my co-pending application Ser. No. 499,278, filed Aug. 21, 1974 for A Faired Rope and A Method and Apparatus for Manufacturing the Rope, now abandoned.

The present invention relates to elongated structures such as ropes or cables having fairings or streamers extending laterally therefrom and to a method and apparatus for producing such structures. More particularly, the present invention relates to so-called faired ropes and methods and apparatus for their manufacture.

In conducting oceanographic studies, and undersea surveillance, hydrophones are customarily utilized to study undersea acoustics. Usually, a series of hydrophones are mounted at spaced intervals along the length of a cable which extends above the ocean floor between buoys which are anchored to the sea bed by guy cables. The hydrophones mounted in this manner are able to pick up sound waves such as waves generated by undersea oil and mineral exploration activities, submarines, aquatic life, etc.

It has been discovered that the hydrophone cable, as well as the guy cables, tend to vibrate when subjected to ocean currents. The strumming noise or sound produced by the vibrating cables aree detected by the hydrophones, and the detected noise is known to interfere with the acoustic studies. In addition, it has been discovered that the strumming attracts fish, and fish have been known to attack the cable. Since it is desirable for such studies to be conducted with a minimum of background noise, it should be apparent that a cable structure which does not have a proclivity to vibrate in response to ocean currents is highly desirable.

It is known that the vibrations and hence the sound produced by vibrating undersea cables can be attenuated by providing fairings or streamers at spaced intervals along the length of the cable. The fairings are normally fabricated of a flexible material which extends laterally of the cable so that each fairing is capable of disposing itself on the down-stream side of the cable to break-up vorticies as the sea water flows across the cable. Thus the cause of cable strumming is eliminated or reduced and cable drag also tends to be reduced.

One type of faired cable which has been used comprises a series of flat relatively-narrow tapes or ribbons secured to the cable at spaced intervals along its length. Although this type of faired cable may function satisfactorily in certain situations, it has limitations. For instance, the tapes are highly flexible. As a result, they can wrap completely around the cable in response to changes in the direction of ocean currents. Needless to say, such wrapping is undesirable since it prevents the fairings from functioning properly. The tapes also have a proclivity for tearing and becoming disconnected from the cable during deployment and recovery. Furthermore, such a faired cable is expensive to manufacture.

There are applications where a strong rope capable of providing fastening points at spaced intervals along its length is desirable. For example, such a rope would find particular utility as a means for connecting a fishing net to a net line. Needless to say, such a rope which is capable of being mass produced economically is highly desirable.

With the foregoing in mind, it is a primary object of the present invention to provide a novel faired rope or cable which is particularly suited for use in oceanographic applications where a minimum of cable-generated noise is desirable.

It is another object of the present invention to provide an improved method and apparatus for manufacturing a faired rope or for securing fairings to an existing steel cable in a continuous and economical manner.

Another object of the present invention is to provide a rope having unique fairings which tend to resist wrapping about the body of the rope in response to changes in direction of fluid flowing across the rope.

It is yet another object of the present invention to provide a faired rope or cable structure which has a minimum of drag when subjected to flowing fluids.

A still further object of the present invention is to provide an improved structure for anchoring fairings to a rope or cable in such a manner as to prevent the fairings from separating from the rope.

As another object, the present invention provides a unique method and apparatus for producing a rope having a series of loops or hangers spaced apart along its length to afford attachment of articles to the rope at spaced intervals.

Yet another object of the present invention is to provide a method and apparatus for producing an elongated article which has a series of fairings spaced apart and secured along its length by a braided jacket but which does not have a separate core element.

Another object of the present invention is to produce a novel faired cord having a relatively small diameter which affords storage in a compact space.

More specifically, the faired rope of the present invention comprises a core having a plurality of yarns surrounded by a layer of resilient material and a jacket braided around the core. Each fairing is provided by a yarn having a base portion anchored between the core and the jacket and leg portions extending laterally away from the core through the jacket. The base portions of the fairing yarns are disposed lengthwise of the rope along at least one side thereof, and the leg portions of axially-adjacent fairing yarns compose each fairing. The braided jacket tightly surrounds the legs of the fairing yarns at the juncture with their bases, and the fairing yarns are preferably of a resilient material. Thus, the fairings are capable of resilient deflection relative to the rope, and they tend to resist wrapping about the rope in response to changes in undersea currents.

In manufacturing the faired rope of the present invention or in applying fairings to a pre-existing cable, the core thereof is advanced lengthwise through a braider which applies the protective jacket around the core, and a length of fairing yarn is laid axially along the core as it advances through the braider to form a base for each fairing. A first length of the fairing yarn extends away from the core and through the eye of a needle which is mounted upstream of the braider for reciprocation in a path parallel to the path of movement of the core. As the core advances and the braid yarns move about the core, the needle is extended, and the first length of the yarn is displaced forwardly through the braid yarns to a limit position where it is gripped by a hook mounted on a frame which overlies the core. The hook engages the yarn, and a second length of yarn is pulled through the eye of the needle as the needle retracts through the braid yarn. The movement of the braid yarns causes the rearwardly-extending length of the fairing yarn to move downwardly against the core to engage the other length of yarn and to form a loop projecting upwardly from the core. Continued operation of the braider causes the jacket to overlay another portion of the fairing yarn which is in contact with the core for forming the base of the next fairing. The fairing loops are severed as the rope advances by a stationary knife mounted on the gripping-hook frame. The axial movement of the core is sensed and converted into a signal which actuates the needle-extension mechanism each time the core moves through a predetermined distance.

The needle and gripping assemblies are designed to cooperate with one another to form each fairing automatically with a minimum of moving parts. For this purpose, the needle is provided with a lateral recess rearwardly of its eye, and a guideway connects the tip of the needle with the lateral recess. The guideway is sized to engage the upper end of the hook which is mounted for resilient deflection relative to the frame of the gripping assembly. Thus, as the needle advances into its forward limit position, the hook engages in the guideway and is deflected downwardly until it registers with the recess, whereupon it moves upwardly to engage behind the yarn for gripping the same and holding it as the needle retracts. The hook also deflects laterally as the needle retracts to disengage the recess. The movement of the rope is sensed by means engaged with the body of the rope and operable through a variable speed transmission to rotate a cam. The cam actuates a switch connected in an electrical circuit to provide the signal to the needle-actuator. The variable-speed transmission permits the relation between the movement of the rope and the extension of the needle to be varied in order to adjust the spacing between the fairings on the rope.

If desired, the needle nose and hook may be inverted to enable the loops to disengage the hook automatically as the article is being manufactured for producing a rope having a series of loops spaced apart along its length. Also, the faired article may be produced by the above method and apparatus without first providing a separate core element.

These and other objects, features and advantages of the present invention should become apparent from the following description when taken in conjunction with the accompanying drawings in which.

Figure 1:
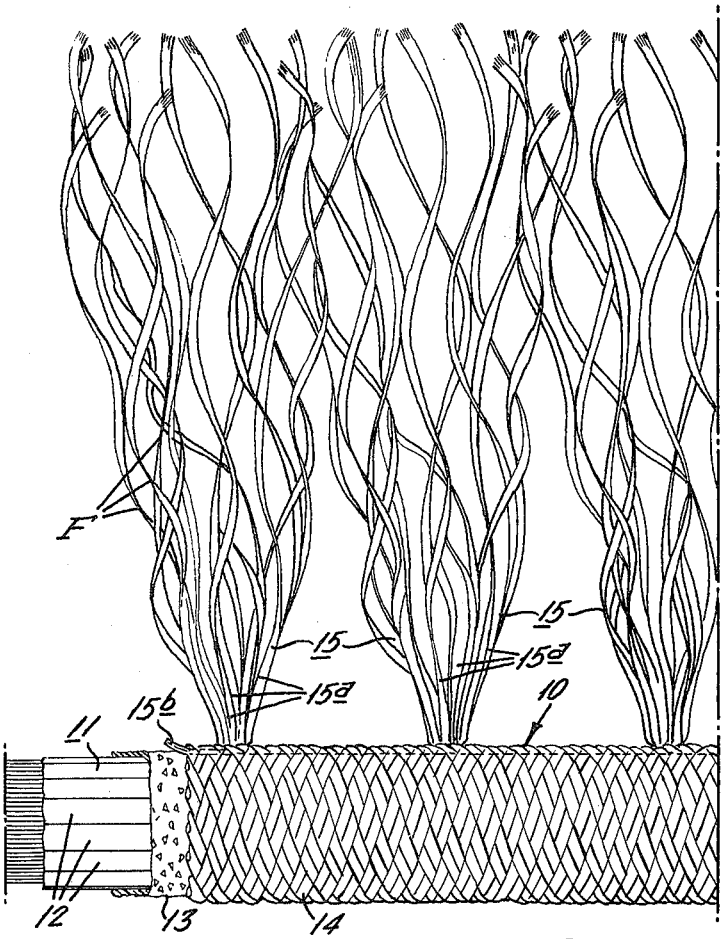
FIG. 1 is a side elevational view of a length of faired rope embodying the present invention, a portion of the protective jacket being removed to expose the construction of the core of the rope.

Referring now to the drawings, FIG. 1 illustrates a short length of a rope or cable assembly 10 embodying the present invention. As best seen therein, the rope assembly 10 comprises a core 11 composed of a plurality of parallel yarns of man-made fibers such as nylon, polyester, Kevlar, etc. surrounded by a layer of resilient material 13, such as neoprene. The core 11 is protected by a braided jacket 14 which surrounds the core 11. The structure of the rope described thus far is set forth more fully in U.S. Pat. application Ser. No. 434,627, filed on Jan. 18, 1974, now U.S. Pat. No. 3,911,785, and entitled "Parallel Yarn Rope". The application is owned by the Assignee of the present application, and a rope having this construction is sold commercially by Wall Industries, Inc. of Beverly, New Jersey, under the registered trademark, Uniline.

Figure 3:
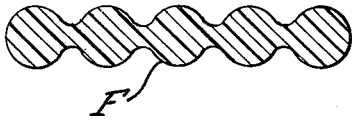
FIG. 3 is a greatly-enlarged, cross-sectional view of a filament of a preferred fairing yarn.

In accordance with the present invention, the rope 10 is provided with a series of fairings or streamers 15, 15 which extend laterally therefrom at spaced intervals along its length. In the illustrated embodiment, the fairings 15, 15 are disposed in a row extending lengthwise of the core along its upper side. Preferably, the fairings are provided by a flexible member such as a fairing yarn Y having strands or filaments F which are of a non-circular cross-section having circular zones connected by frangible weakened sections, as illustrated in FIG. 3, the weakened sections affording desirable longitudinal separation of the circular zones from one another. The strands are twisted slightly to provide the yarn with sufficient coherency to facilitate manufacturing without causing excessive twist-liveliness, as described hereinafter. The filaments are preferably fabricated of a resilient material such as polypropylene, which is also desirable because it reduces the total weight in the water of the faired rope. A fairing yarn of the preferred cross-section and material is sold under the trade designation, Parapro, by Wall Industries, Inc. of Beverly, New Jersey.

Figure 2:
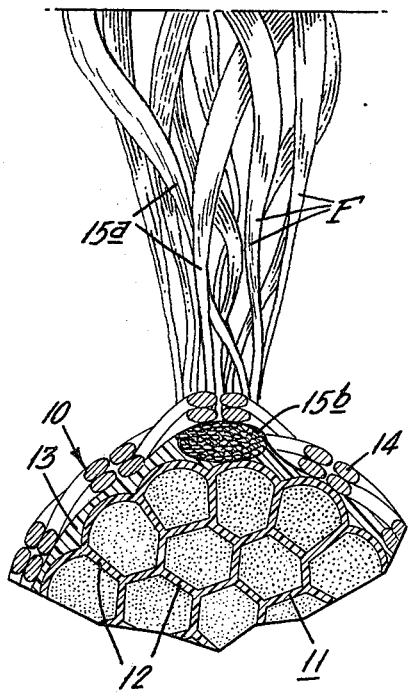
FIG. 2 is a greatly-enlarged, fragmentary sectional view of the faired rope illustrated in FIG. 1.

The fairings 15,15 are firmly secured to the rope 10. For this purpose, 15, 15 fairing 15 is provided by a relatively short length of a multi-stranded fairing yarn which has a substantially U-shaped configuration with outwardly-extending streamer or leg portions 15*a*, 15*a* and a base portion 15*b* connecting the leg portions. The base portion 15*b* extends for a short distance lengthwise of the rope 10 along at least one side and is anchored between the jacket 14 and the core 11, as illustrated in FIG. 2. The base portions 15*b*, 15*b* are aligned endwise longitudinally of the core 11, and the resilient layer 13 interacts with the base portions 15*b* of the fairing yarn Y and the tightly-braided jacket 14 to anchor the fairings 15, 15 securely to the rope 10.

As best seen in FIG. 1, the leg portions 15*a*, 15*a* of the fairing yarn are bunched or grouped together tightly at their juncture with the jacket 14 to form the fairing 15. This bunching, combined with the inherent resiliency of the fairing yarn, cooperates to mount the fairings 15, 15 in cantilever fashion with respect to the body of the rope. As a result, the fairings 15, 15 tend to resist wrapping around the rope in response to changes in direction of the fluid flowing across the rope.

The lengths of the fairings 15, 15 and their axial spacing may vary, depending upon the vibration and sound attenuation desired. By way of example, a rope of the above construction having a diameter of three-fourths inch, and fairings five inches in length spaced apart axially approximately 1 inch, has been tested satisfactorily. The faired rope which was tested had fairings fabricated of the aforementioned Parapro polypropylene fairing yarn of 7500 denier providing a fairing 15 of 15,000 denier. The axial spacing between the fairings was varied from 1 to 8 inches, and it was determined that a significant change in vibration levels occurred when the spacing was varied from 1 to 2 inches, although good vibration damping occurred even at the higher spacings. The tests revealed that the faired rope of the present invention has a vibration or noise level approximately 1/40 to 1/100 of the noise level of a rope of similar construction which does not have fairings. The lengths of the fairings (measured from the outside of the rope) should be in a range of about 5–12 times the rope diameter, and the spacing between the fairings should be in a range of about 0.5 to 3 times the rope diameter. Although it may be possible to employ a nylon monofilament yarn satisfactorily, a nylon multifilament yarn should not be used except in those situations where wrapping would not be objectionable.

In manufacturing the faired rope of the present invention, the fairings 15, 15 are produced automatically in a continuous manner as the core 11 advances axially. To this end, the apparatus illustrated in FIG. 4 is provided for manipulating the fairing yarn Y during braiding of the jacket 14 in such a manner as to cause the fairings 15, 15 to be formed downstream of the braider.

As best seen therein, the braider causes braid yarns 14*a*, 14*a* to move in a path about the core 11 in a braid zone Z, and the fairing yarn Y is fed into the braid zone Z where it is manipulated by a needle 21 and gripping assembly 25. The needle 21 is reciprocated parallel to the path of movement of the core 11 and through the path of movement of the braid yarns 14*a*, 14*a* by a linear-actuator 22 mounted upstream or rearwardly of the braid zone Z. A spreader ring 23 surrounds the core 11 and is secured to the braider upstream of the braid zone Z to engage the braid yarns 14*a*, 14*a* as they advance about the core 11. When the needle 21 is in its home position, illustrated in broken lines in FIG. 4, the braider functions to braid the yarns 14*a*, 14*a* about the core 11 as it advances forwardly in the direction of the arrow. When in the home position, a short length of the braid yarn (which forms the base 15*b*) is disposed against the upper side of the core 11, and a longer first length Y extends laterally and rearwardly from the core through a guide or eye 20 of the needle 21 and to a supply cone (not shown).

Figure 4:
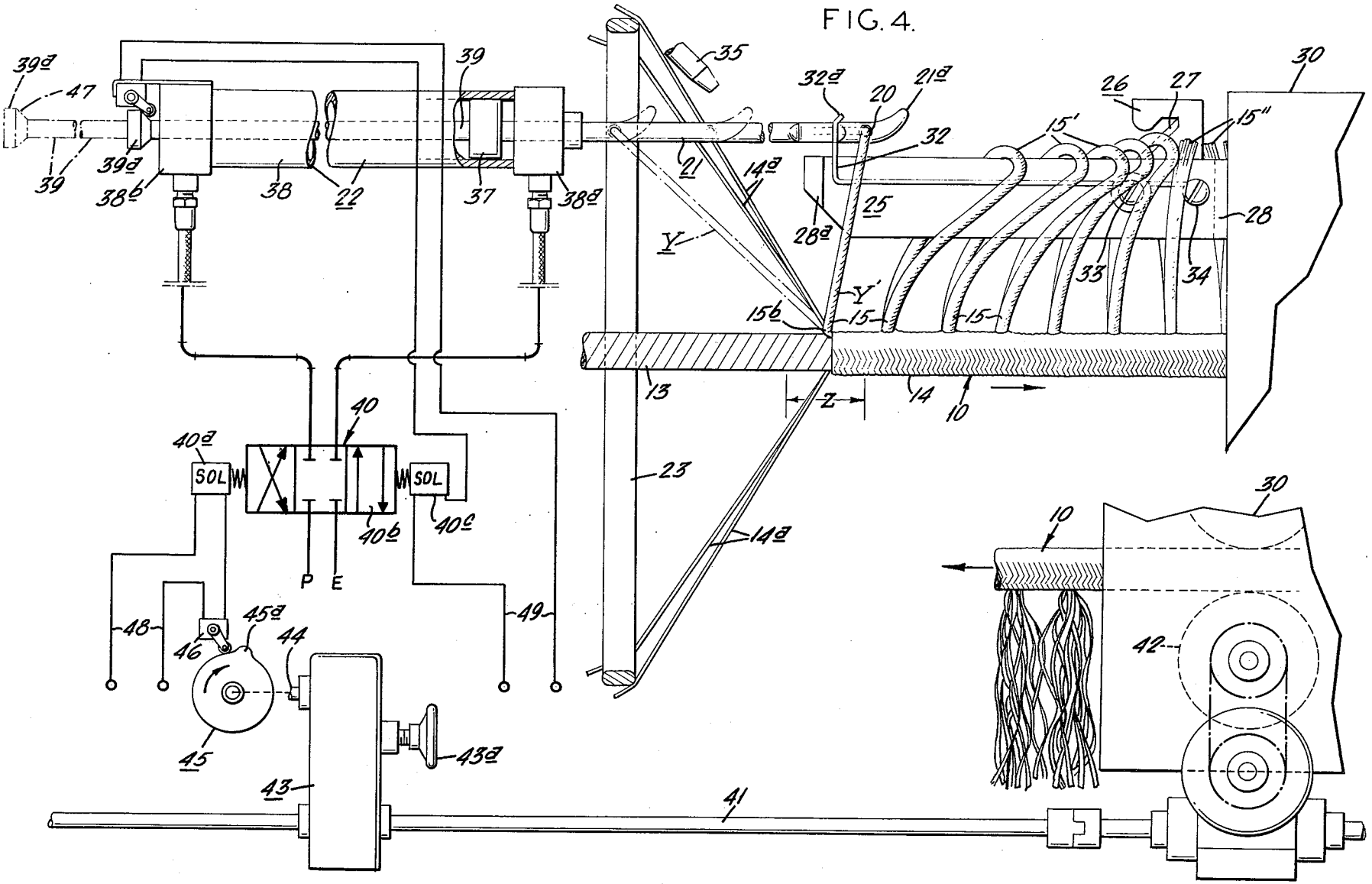
FIG. 4 is a view illustrating schematically apparatus for practicing the present invention.
Figure 8:
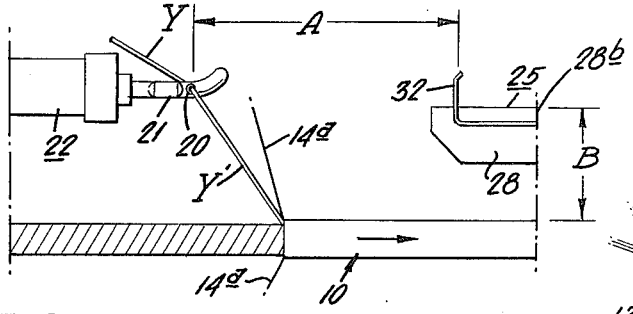
FIGS. 8–12 are views illustrating schematically the movement of the fairing yarn during operation of the apparatus of the present invention.
Figure 9:
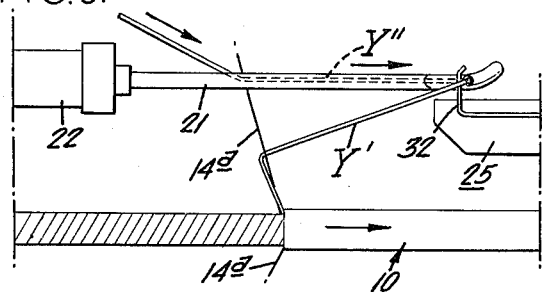
Figure 10:
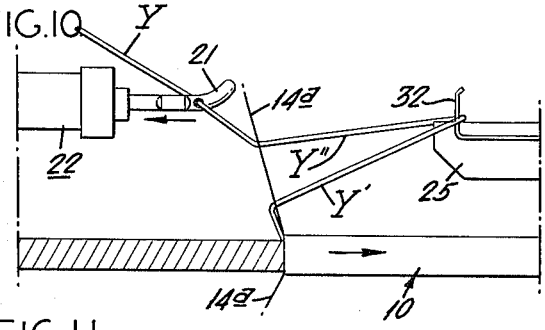
Figure 11:
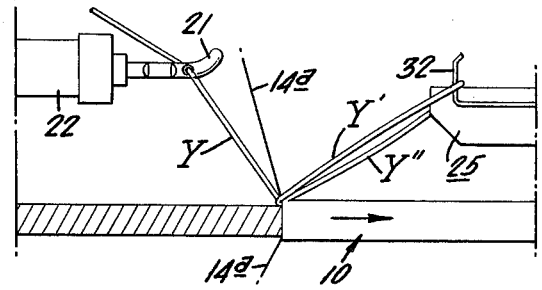
Figure 12:
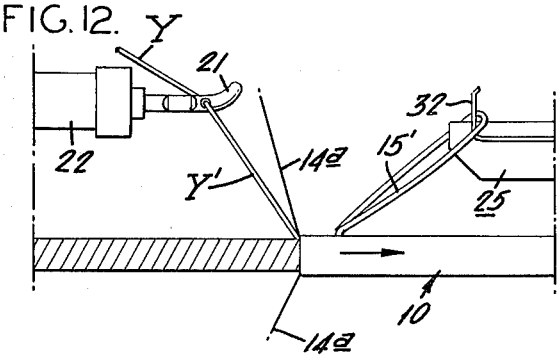

In order to form the loops 15', 15', the needle 21 is extended into its forward limit position, illustrated in full lines in FIG. 4, and the fairing yarn Y is gripped by the gripping assembly 25. Thus, when the needle 21 retracts into its home position, another or second length Y'' of the fairing yarn is pulled through the eye 20 of the needle 21, and this length Y'' extends rearwardly from the gripping assembly 25 and through the path of movement of the braid yarns 14*a*, 14*a*. The various positions of the needle 21, gripping assembly 25, and fairing yarn Y are illustrated schematically in FIGS. 8–12. For instance, in FIG. 8, the needle 21 is in its home position, as in FIG. 4. In FIG. 9, the needle 21 is illustrated in its forward limit position with the yarn Y gripped by the hook 32 of the gripping assembly 25. FIG. 10 illustrates the position of the needle 21 immediately after retraction through the braid yarns 14*a*, 14*a* with the fairing yarn Y extending through the braid yarns 14*a*, 14*a* and toward the hook from a position relatively close to the needle 21. FIG. 11 illustrates the needle 21 adjacent its home position, and FIG. 12 illustrates the needle 21 in its home position. The aforedescribed action of the braid yarns 14*a*, 14*a* in displacing both legs Y' and Y'' of the fairing yarn Y toward the core 11 is illustrated with particularity in FIGS. 10 and 11.

Figure 13:
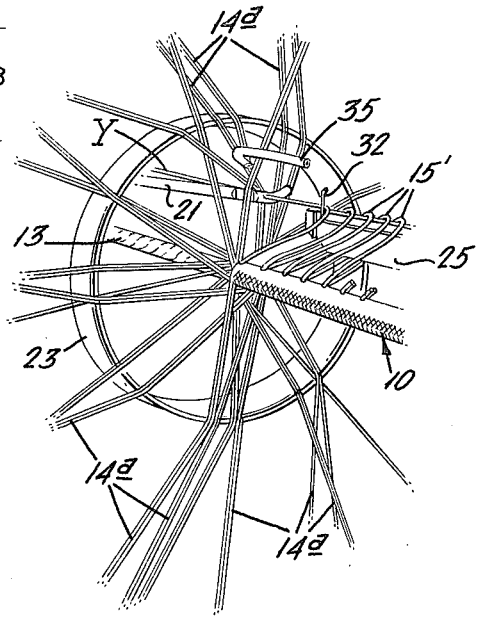
FIG. 13 is a fragmentary perspective view illustrating the bunching of braid yarns against the side of the needle and fairing yarn during extension of the needle.

During the brief period of time while the needle 21 is in its forward limit position, the braid yarns 14*a*, 14*a* tend to bunch against the sides of the needle 21 since it is located in the path of movement of the braid yarns. For instance, see FIGS. 5 and 13. However, after the needle 21 disengages the braid yarns 14*a*, 14*a*, the braid yarns cooperate with the gripping assembly 25 to cause the lengths Y' and Y'' of the fairing yarn Y to be displaced laterally inward against the core 11. Continued braiding of the braid yarns 14*a*, 14*a* about the portion of the fairing yarn Y engaged with the core 11 causes the base portion 15*b* of the next fairing 15 to be formed, and continued reciprocation of the needle 21 in cooperation with the gripping assembly 25 and the action of the braider causes the succession of axially-spaced loops 15', 15' to be produced.

In order to provide the fairings 15, 15 with free ends, the loops 15', 15' are severed as the rope assembly 10 advances. For this purpose, a stationary knife 26 having an upwardly and forwardly inclined cutting blade 27 is mounted in a stationary frame 28 a spaced distance above the path of movement of the rope 10. Thus, as the rope 10 advances, the loops 15', 15' engage the blade 27 and are severed, thereby forming double-legged fairings, such as indicated at 15'' in FIG. 4. Thereafter, the rope assembly 10 enters a heating chamber 30 which cures the rope 10, as described in the referenced patent application. When the rope assembly 10 exits the dryer 30, after passing over rollers therein, the fairings have the tufted appearance illustrated in the lower right-hand corner of FIG. 4.

The present invention provides novel apparatus for use in practicing the method steps described thus far. To this end, the needle 21 is designed to cooperate with the gripping assembly 25 in a manner which causes the fairing yarn Y to be gripped automatically when the needle 21 reaches its forward limit position. In the illustrated embodiment, the gripping means 25 includes a hook 32 fabricated of resilient material such as spring steel, and the hook is mounted at its rear end by fasteners 33 and 34 connected to one side of the stationary frame 28. The hook 32 has an upper end 32*a* which is forwardly-turned and normally disposed in the path of movement of the needle 21 when the hook 32 is in its home position illustrated in FIG. 4. Thus, the hook 32 is engaged by the front end 21*a* of the needle 21 as the needle extends. The hook 32 is biased into this position by virtue of its mounting to the frame 28 and its inherent resiliency.

Figure 6:
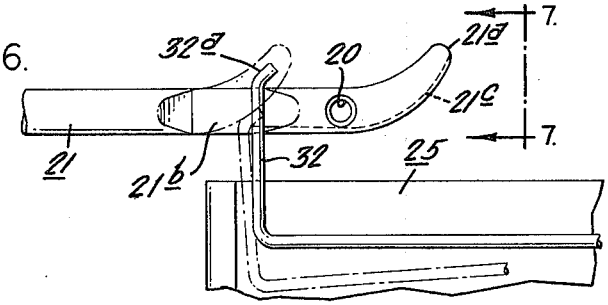
FIG. 6 is a side elevational view of the needle and gripping assembly illustrated in FIG. 5.
Figure 7:
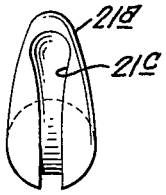
FIG. 7 is an enlarged end elevational view taken along lines 7—7 of FIG. 6 to illustrate a guideway provided in the front end of the needle.

In order to grip the yarn Y, the needle 21 is provided with a lateral recess 21*b* located rearwardly of its eye 20 and a downwardly-open, longitudinally-extending guideway 21*c* extending from its front end 21*a* to the recess 21*b*, as illustrated in FIGS. 6 and 7. As best seen in FIG. 6, the front end or tip 21*a* of the needle 21 is upturned, and the guideway 21*c* is sized to receive the upper end 32*a* of the hook 32. Thus, when the needle 21 engages the upper end 32*a* of the hook 32, it displaces the hook 32 downwardly against its bias, into the position illustrated in broken lines in FIG. 6. After the needle 21 reaches its forward limit position, illustrated in full lines in FIG. 4, the upper end 32*a* of the hook 32 enters the lateral recess 21*b* in the needle 21 and springs upwardly by its inherent resiliency to cause its upper end 32*a* to be disposed above the level of the needle-eye 20. Hence, as the needle 21 retracts, the upper end 32*a* of the hook 32 engages the fairing yarn Y and holds the same adjacent the frame 28 while the needle 21 retracts to its home position and pulls fairing yarn Y through its eye 20. It is noted that the hook 32 is mounted to the frame 28 in a manner which also affords lateral movement of its upper end 32*a*, so that the hook 32 is capable of sliding out of the recess 21*b* and along the side of the needle 21 as the needle 21 retracts.

Figure 5:
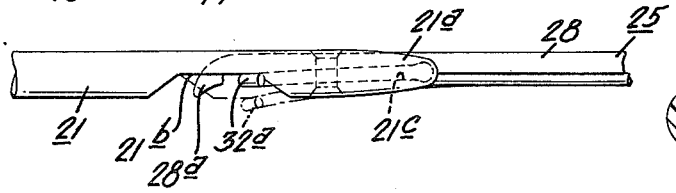
FIG. 5 is a greatly-enlarged, fragmentary view of a portion of the needle and gripping assembly illustrated in FIG. 4, the view illustrating in full-lines the needle in its forward limit position and illustrating in broken lines the needle during retraction from its forward limit position.

As the lengths Y′ and Y″ of the fairing yarn Y move downwardly to form the loop 15, they tend to vibrate laterally due to their engagement with the braid yarns 14*a*, 14*a*. In order to prevent this motion from causing the loops 15′, 15′ to disengage the frame 28, the rearward end of the frame 28 is provided with a curved nose 28*a* adjacent the braid zone Z, as illustrated in FIG. 5, and at least one nozzle 35 is provided adjacent the nose 28*a* to direct a stream of air forwardly against the upper ends of the loops 15′, 15′. The nose 28*a* curves around the rearward end of the hook 32 and toward the side of the frame 28 on which the hook 32 is mounted and cooperates with the air emitted from the nozzle 35 to ensure that the loops 15′, 15′ straddle the frame 28 as they advance. As noted heretofore, the fairing yarn Y should have enough twist to form coherent loops but not too much twist as to be twist-lively at the front end of the frame 28.

In producing the fairings 15, 15, it is important for the core 11 of the rope to be spaced from the upper edge 28*b* of the frame 28 a dimension B (FIG. 8) which is less than the stroke A of the needle 21 to ensure operation of the apparatus. By way of example, the dimension A should be about twice the dimension B to produce the fairings of the illustrated embodiment. At a minimum, however, the dimension A should be at least as great as the dimension B.

The fairings 15, 15 are spaced apart at equal intervals along the length of the rope 10. Such spacing is ensured in the method of the present invention wherein the longitudinal displacement of the rope 10 is sensed, the sensed displacement is converted into a control signal, the needle 21 is extended in response to the signal, and the needle 21 is automatically retracted. In practicing these method steps, the linear actuator 22 includes a piston 37 slidably mounted within a casing 38. The needle 21 is connected to the forward end of the piston 37, and an elongated rod 39 extends rearwardly through the casing 38 beyond its rearwardmost end 38*b*. A pressure fluid, in the present instance compressed air, is supplied alternately to the front end 38*a* and the rear end 38*b* of the casing 38 by a solenoid-actuated valve assembly 40 which is connected to a source of pressure fluid (indicated as P) and to an exhaust (indicated as E). Thus, the admission of pressure fluid into the rear end 38*b* of the casing 38 drives the piston 37 forwardly and extends the needle 21; whereas the admission of pressure fluid into the front end 38*a* of the casing causes the piston 37 to move in the rearward direction to retract the needle 21.

In order to extend the needle 21 in response to a measured displacement of a rope assembly 10, the displacement of the rope is sensed by a line shaft 41 which, as described in the aforementioned patent application, cooperates with a tensioning roller 42 engaged with the rope assembly 10 in the drying chamber 30. The line shaft 41 is connected through a variable speed transmission 43 to a rotatable shaft 44 which mounts a circular cam 45. The cam 45 has a lobe 45*a* which actuates a normally-open switch 46 each time the shaft 44 makes one complete revolution. The switch 46 is connected in a circuit 48 to the left-hand solenoid 40*a* of the valve assembly 40 to actuate the same when the cam-lobe 45*a* engages the switch 46. When actuated, the solenoid 40*a* displaces the spool 40*b* of the valve assembly 40 leftward to cause pressure fluid to be supplied to the rear end 38*b* of the casing 38 and to be exhausted from the front end 38*a* to drive the piston 37 forwardly, and hence to extend the needle 21. In the illustrated embodiment, the cam-lobe 45*a* is designed to ensure displacement of the spool 40*b* into its leftward limit position, where it remains until returned to its rightward limit position.

In order to return the needle 21 automatically to its home position, a limit switch 47 is mounted on the rear end 38*b* of the cylinder 38. A cam element 39*a*, mounted on the rod 39, engages the limit switch 47 as the needle 21 moves into its forward limit position. The normally-open limit switch 47 is electrically connected to the righthand solenoid 40*c* by the circuit 49 and operates to energize the solenoid 40*c* when engaged by the cam element 39*a*. When the solenoid 40*c* is energized, the valve spool 40*b* is displaced rightward, and pressure fluid is applied to the front end 38*a* of the cylinder 38 and exhausted from the rear end 38*b*, thereby driving the piston 37 leftward and retracting the needle 21. Preferably, the cam element 39*a* is mounted for adjustment longitudinally relative to the operating rod 39, and the cam element 39*a* is positioned at such a location on the rod 39 as to cause the solenoid 40*c* to be activated slightly before the needle 21 reaches its forward limit position in order to compensate for the response time required by the control system and to provide an air cushion in the front end 38*a* of the cylinder 38 for minimizing shocks and vibrations in the needle-actuator mechanism.

For purposes of illustration, the cam lobe 45*a* is shown displaced clockwise from the extend-needle limit switch 46, having caused the needle 21 to move substantially into its forward limit position. The cam element 39*a* on the piston rod 39 is illustrated in a position where it is engaged with the limit switch 47 as the switch 47 is actuated. The solenoid valve 40 is illustrated in its neutral position corresponding to the brief interval during which the switch 47 is causing it to reverse directions.

For the purpose of varying the axial spacing between the fairings 15, 15, the transmission 43 is provided internally with means to vary the ratio between the angular displacement of the line shaft 41 and the angular displacement of its output shaft 44. The internal mechanism is operated by an adjustment wheel 43*a* outside the transmission 43. Thus, by rotating the adjusting wheel 43*a*, the displacement of the rope assembly 10 required before the needle 21 is actuated may be varied, and the spacing between the fairings 15, 15 may be varied accordingly.

Figure 14:
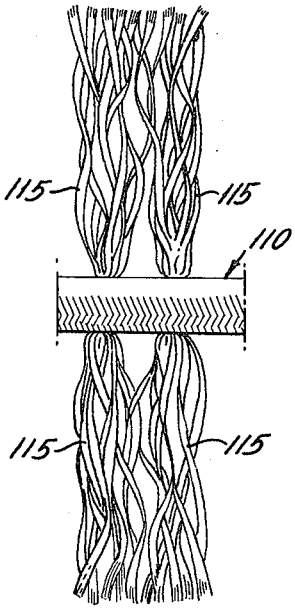
FIGS. 14 and 15 are side elevational views of modified embodiments of the present invention.

Although the faired rope illustrated in FIGS. 1 and 2 has fairings extending along only one side, it may be desirable in certain applications for a rope 210 (FIG. 14) to be provided with two or more rows of fairing 115, 115. The rows may be offset angularly with respect to one another such as along diametrically-opposite sides of the rope. Such a faired rope would be manufactured by providing a second needle and gripping assembly offset with respect to the first needle and gripping assembly.

Figure 15:
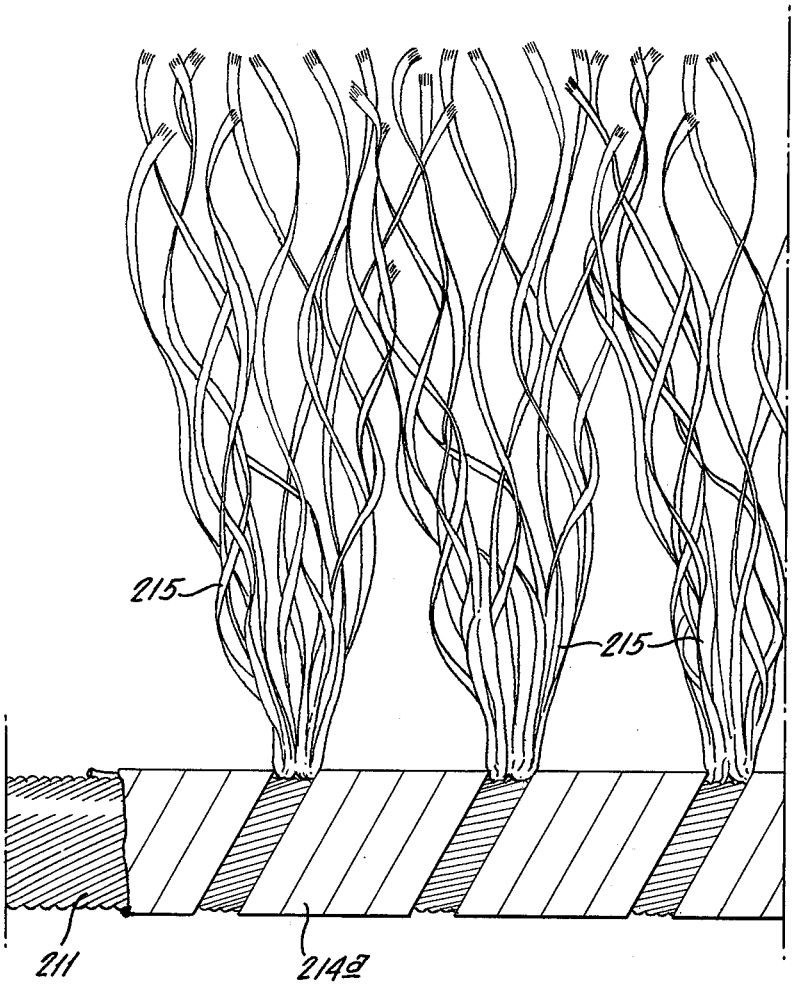

Although the present invention has been described with reference to applying fairings onto a parallel yarn rope, it should be apparent that the method and apparatus may be employed satisfactorily in applying fairings onto other elongated structures such as braided ropes and steel cables. For example, there is illustrated in FIG. 15 a modified embodiment of the present invention wherein fairings 215 are applied onto a steel cable 211. In this embodiment, the jacket is provided by a tape 214*a* which is wrapped helically about the cable 211 as it advances lengthwise through a tape server. The tape 214*a* may have an adhesive on its inner side capable of bonding to the steel cable with the application of heat; or an uncured neoprene tape which is cured in the dryer 30 could be utilized. Of course, the jacket could be applied by a braider, as in the embodiment of FIGS. 1 and 2; however, in such event, it would be desirable for the cable 211 to be wrapped with neoprene or other resilient tape prior to braiding in order to ensure secure mounting of the fairings to the cable.

Figure 16:
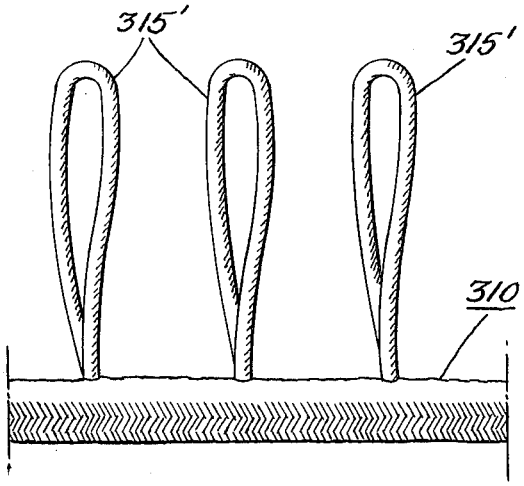
FIG. 16 is a side elevational view of a short section of a faired rope, such as illustrated in FIG. 4, having a series of loops extending therefrom in spaced relation along its length.

In accordance with another object of the present invention, a length of rope having a series of hangers spaced apart along its length is provided. As best seen in FIG. 16 (Sheet 5) a length 310 having a series of spaced loops 315′, 315′ extending laterally therefrom is manufactured similarly to the way in which the length of rope 10 illustrated in FIG. 4 is manufactured. In this embodiment, however, the loops 315′, 315′ are not severed by the knife 26, so that the loops 315′, 315′ provide a strong and convenient hanger means affording the connection to the rope 310 at spaced intervals of things such as fish nets, etc.

Figure 17:
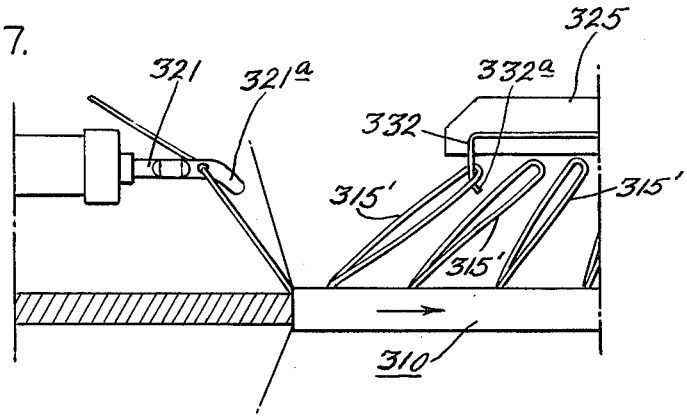
FIG. 17 is a schematic diagram similar to FIG. 12 but illustrating apparatus for producing the rope illustrated in FIG. 16.

In order to produce the rope 310, the apparatus illustrated in FIG. 4 need be modified only slightly. For instance, as best seen in FIG. 17, the tip 321*a* of the needle 321 is inverted, so that the guideway therein faces away from the path of movement of the rope 310. In addition, the hook 332 is disposed so that its end 332*a* depends below its mounting frame 325 and extends toward the rope 310 so as to be engaged periodically by the needle 321 as it reciprocates. With this structure, the loops 315′, 315′ disengage the hook 322 automatically as the rope 310 advances forwardly.

Figure 18:
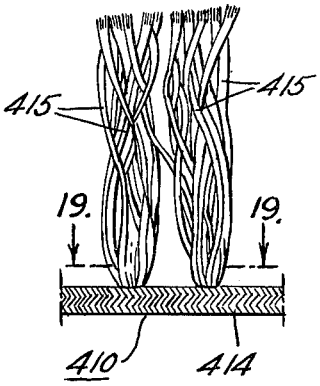
FIG. 18 is a side elevational view of a small diameter faired cord embodying the present invention.
Figure 19:
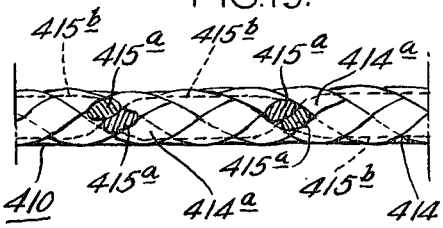
FIG. 19 is a sectional view taken along line 19—19 of FIG. 18.

According to a further object of the present invention, the apparatus of FIG. 4 also may be utilized to produce a faired article having a relatively small diameter, such as the faired cord 410 illustrated in FIG. 18. Unlike the embodiment of FIG. 1, however, this embodiment of the present invention does not have a separate core element; rather the elongated braided jacket 414 alone mounts the plurality of fairings 415, 415 which extend therefrom at spaced intervals along the length of the cord 410. As best seen in FIG. 19, each fairing 415 has an axially-extending base portion 415*b* and a pair of streamer portions 415*a*, 415*a* which extend outwardly between braid yarns 414*a*, 414*a* of the braided jacket 414 and which are bunched together at the surface of the jacket 414. The section of the jacket 414 between the streamers 415*a*, 415*a* surrounds and tightly grips the axially-extending base portion 415*b* to secure the fairing to the cord. Of course, as tension on the cord 410 increases, the braid yarns 414*a*, 414*a* cooperate to increase their gripping action on the streamers 415, 415.

Figure 20:
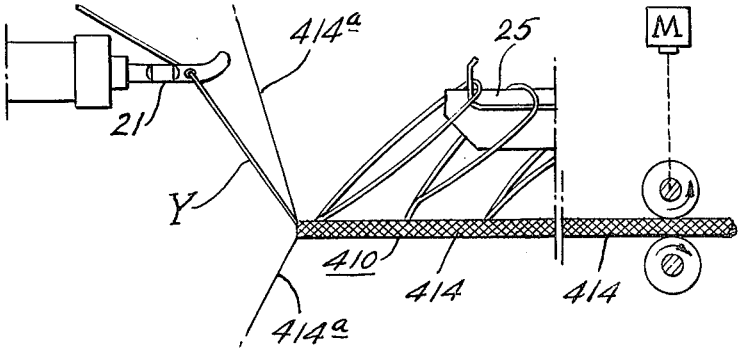
FIG. 20 is a schematic diagram similar to FIG. 12 but illustrating the faired cord being formed without a separate core element.

The faired cord 410 is produced by the apparatus illustrated in FIG. 4 which, of course, is modified slightly to produce the smaller diameter article and to compensate for the absence of a core. For instance, as best seen in FIG. 20, the apparatus has drive roll means engaging the jacket 414 to advance the same forwardly away from the braider as it advances braid yarns 414*a*, 414*a* in a circular path about the longitudinal path of movement of the cord to braid the jacket in a well known manner. As contrasted with the method and apparatus of FIG. 4, the jacket 414 is not braided around a separate core element. Rather, the fairing yarn Y is simply manipulated by the needle and gripping assembly 21 and 25 in the manner already described with reference to FIG. 4 to produce the cord-like article 410. Note the absence of a separate axially-advancing core element upstream of the braid zone. Of course, if desired, a separate core of a low-temperature thermosetting adhesive may be supplied as in FIG. 4 to augment the gripping action provided by the braid yarns 414*a*, 414*a* and to provide additional means to securely mount the fairings.

In view of the foregoing, it should be apparent that the present invention now provides an improved method and apparatus for manufacturing a novel faired rope or cable. The fairings are securely fastened to the ropes, they resist wrapping about the ropes, and the faired ropes are manufactured economically in a continuous process.

Thus, while preferred embodiments of faired ropes and a preferred method and apparatus for manufacturing such ropes have been described in detail, various modifications, alterations or changes may be made without departing from the spirit and scope of the present invention as defined in the appended claims.

I claim:

1. A method of manufacturing an elongated structure having a core and a plurality of flexible members extending outwardly from the core at spaced intervals along its length, comprising the steps of:

advancing the core axially in a forward direction, applying a jacket to said core as it advances axially, laying axially along said core as it advances a portion of an elongated flexible member to form a base for said flexible members while disposing a first length of said member laterally with respect to said base portion through a guide moveable alongside said core, displacing said guide with said first length of said flexible member forwardly relative to said moving core and into a limit position beyond said base portion, gripping said displaced first length at said forward limit position, retracting said guide rearwardly while said displaced length is gripped at said limit position to cause a second length of said member to be drawn through said guide and to extend rearwardly from said forward limit position, causing said first and second lengths to be displaced laterally inward toward said core while maintaining said member gripped at said location to form a said member into a loop extending laterally of the core, and continuing said jacket-applying step rearwardly of said inwardly-displaced lengths of said member as said core advances to cause the base portion of an axially-adjacent member to be formed, whereby the members are applied to the core in a continuous process.

2. A method according to claim 1 including the step of automatically severing said loop as said core advances.

3. A method according to claim 1 including the steps of sensing the longitudinal displacement of said core as it advances, converting said sensed displacement into a control signal, extending said guide in response to said control signal, and automatically retracting said guide upon gripping of said flexible member at said limit position, whereby the members are spaced apart accurately at predetermined intervals along the length of the core.

4. Apparatus for producing a structure having a series of flexible members extending therefrom at spaced intervals along its length, comprising:

means for advancing an elongated core axially in a forward direction, means moveable in a path about said core to apply a jacket thereto as said core advances, guide means adapted to slidably receive a flexible member at a location spaced from the core and to define a first length of said member extending away from said core, means connected to said guide means for reciprocating the same through said path from a home position located rearwardly of said path to limit position located forwardly of said path, means for gripping said flexible member at said limit position and holding the same while said reciprocating means returns said guide means to its home position for drawing a second length of said member through said guide means, and means engaging and displacing a rearward portion of said lengths of said member inwardly against said core to form said member into a loop extending away from said core, whereby the apparatus produces a structure with a series of laterally-extending flexible members each having a base portion fastened securely to the core by the jacket.

5. Apparatus according to claim 4 including means located forwardly of said gripping means to sever said loop as the same advances forwardly with the core.

6. Apparatus according to claim 4 including means to sense the axial displacement of said advancing core, means for producing a control signal in response to a predetermined sensed displacement, and means responsive to said control signal to actuate said reciprocating means.

7. Apparatus according to claim 6 including adjusting means associated with said displacement sensing means and said signal producing means to vary the displacement required to produce said control signal, whereby the number of reciprocations of the guide means per unit length of the core may be adjusted for varying the axial spacing of the members.

8. Apparatus according to claim 7 wherein said displacement sensing means includes means engaged with the structure and having a shaft rotatable through an angle proportional to the axial displacement of said core, said signal producing means includes switch means and a rotary cam associated therewith to actuate said switch means upon rotation thereof, and said adjusting means includes a variable speed transmission connected between said cam and said shaft to permit the proportion between the angular displacement of the cam and the angular displacement of the shaft to be varied.

9. Apparatus according to claim 8 wherein said reciprocating means includes a linear actuator having a casing and a piston mounted therein, said guide means being connected to said piston for movement therewith, valve means associated with said actuator and selectively operable to drive said piston in opposite directions in said casing, said switch means being connected to said valve means and cooperable with said cam to displace said piston and guide means in a forward direction, and including limit switch means associated with said linear actuator and operable automatically to cause the valve means to drive the piston in the rearward direction as the guide means reaches its forward limit position.

10. Apparatus according to claim 4 wherein said guide means includes a needle having a forward end with an eye for slidably receiving said member, and said gripping means includes a frame provided adjacent said limit position, a hook carried by said frame, resilient means mounting said hook to said frame for biasing said hook into the path of movement of the needle so that said hook is engaged by the forward end of the needle as it advances into its forward limit position, said front end of said needle and said hook having cooperating surface means for moving said hook into position rearwardly of said eye as said needle moves forwardly, so that when the reciprocating means displaces the needle rearwardly, the member is engaged by the hook and gripped at said forward limit position and said second length is pulled through said eye.

11. Apparatus according to claim 10 wherein said needle has a tip forwardly of said eye, and said needle surface means includes a lateral recess rearwardly of said eye and longitudinally-extending guideway connecting said tip with said recess, said guideway being shaped to receive said hook and to displace the same against its bias inwardly toward said core and said recess being shaped to cam the hook laterally as the needle moves rearwardly, whereby the hook slides along the recess beyond the eye to catch the flexible member.

12. Apparatus according to claim 10 wherein said frame extends alongside the path of movement of said core and has a rearwardly-extending nose curving around said hook toward the side of the needle having the recess, and including means to direct a flowing medium forwardly against said nose, hook and frame for cooperating therewith to cause said loop to straddle said frame and to advance therealong as the core advances.

13. Apparatus according to claim 10 including a stationary knife blade mounted on said frame forwardly of said hook, said blade having an edge inclinded outwardly and forwardly of said frame for engaging said loop to sever the same as the core advances relative to the frame.

14. Apparatus according to claim 10 wherein said hook has a tip extending toward the path of movement of the core, and said longitudinal guideway faces away from said path of movement, whereby the hook automatically disengages the fairings as the rope advances forwardly.

15. Apparatus according to claim 4 wherein said jacket applying means includes means for braiding yarns about said core and causing said braid yarns to move in said path about said core for engaging said member and displacing the same against said core as said guide means returns to its home position.

16. A method of manufacturing an elongated article having a plurality of fairings spaced apart along its length, comprising the steps of:

braiding a section of a jacket around a base length of a flexible member in a braiding zone, advancing the jacket and base length axially in a forward direction, disposing a first length of said member laterally with respect to said base length through a guide moveable relative to said jacket, displacing said guide with said first length of said flexible member forwardly through said braiding zone relative to said moving jacket into a limit position beyond said base length, gripping said displaced first length at said forward limit position, retracting said guide rearwardly while said displaced length is gripped at said limit position to cause a second length of said flexible member to be drawn through said guide and to extend rearwardly from said forward limit position, and continuing said braiding to cause said first and second lengths to be displaced laterally inward while maintaining said member gripped at said location to form a said member into a laterally extending loop, and further continuing said braiding rearwardly of said inwardly-displaced lengths of said member as said jacket advances to cause the jacket to surround another base length of said member, and repeating said above steps, whereby an elongated faired article is manufactured in a continuous process.

17. Apparatus for producing a structure having a series of flexible members extending therefrom at spaced intervals along its length, comprising:

a braider operable to advance braid yarns in a predetermined path to fabricate a braided jacket, means for advancing said jacket axially in a forward direction, guide means adapted to slidably receive a flexible member at a location spaced laterally from the jacket and to define a first length of said member extending away from said jacket, means connected to said guide means for reciprocating the same through said path from a home position located rearwardly of said path to limit position located forwardly of said path, means for gripping said flexible member at said limit position and holding the same while said reciprocating means returns said guide means to its home position for drawing a second length of said member through said guide means, said braider operating to cause said braid yarns to displace rearward portions of said lengths of said member laterally toward the path of movement of said jacket and thereafter to braid said jacket around a section of said flexible member before said guide means is again advanced forwardly.

* * * * *